US006533245B2

(12) United States Patent
Takemoto et al.

(10) Patent No.: US 6,533,245 B2
(45) Date of Patent: Mar. 18, 2003

(54) VALVE DEVICE

(75) Inventors: Masao Takemoto, Shimonoseki (JP); Masakazu Hirano, Shimonoseki (JP); Kazuhiko Watanabe, Setagaya-ku (JP); Teruyuki Hotta, Nagoya (JP); Shigeji Ohishi, Anjo (JP)

(73) Assignees: Kabushiki Kaisha Kobe Seiko Sho, Kobe (JP); Denso Corporation, Kariya (JP); Fujikoki Corporation, Tokyo (JP)

( * ) Notice: Subject to any disclaimer, the term of this patent is extended or adjusted under 35 U.S.C. 154(b) by 0 days.

(21) Appl. No.: 09/968,545

(22) Filed: Oct. 2, 2001

(65) Prior Publication Data

US 2002/0043640 A1 Apr. 18, 2002

(30) Foreign Application Priority Data

Oct. 3, 2000 (JP) ..... 2000-303278

(51) Int. Cl.[7] ..... F16K 31/64
(52) U.S. Cl. ..... 251/368; 236/92 B
(58) Field of Search ..... 251/368; 236/92 B

(56) References Cited

U.S. PATENT DOCUMENTS 4,134,759 A * 1/1979 Yajima et al. ..... 75/229
5,460,349 A 10/1995 Campbell et al.
5,692,726 A * 12/1997 Adachi et al. ..... 251/368
6,089,843 A * 7/2000 Kondoh ..... 251/368
6,092,733 A 7/2000 Watanabe et al.

FOREIGN PATENT DOCUMENTS

| | | |
|---|---|---|
| DE | 24 58 201 | 6/1976 |
| DE | 198 32 489 | 1/1999 |
| EP | 0 781 970 | 7/1997 |
| EP | 0 831 283 | 3/1998 |
| EP | 0 943 878 | 9/1999 |
| JP | 2000-282162 | 10/2000 |

* cited by examiner

*Primary Examiner*—Paul J. Hirsch
(74) *Attorney, Agent, or Firm*—Oblon, Spivak, McClelland, Maier & Neustadt, P.C.

(57) ABSTRACT

A valve device including a main body formed with a passage for allowing a refrigerant to flow therethrough; and a valve member provided in the passage. The main body includes an aluminum alloy containing 0.2 to 1.5 weight % of Si; 0.2 to 1.5 weight % of Mg; 0.001 to 0.2 weight % Ti; at least 0.1 weight % of Mn, Zr or the both; and Al and inevitable impurities, and having a fiber structure.

12 Claims, 4 Drawing Sheets

VALVE DEVICE

BACKGROUND OF THE INVENTION

1. Field of the Invention

The present invention relates to a valve device for a refrigerating cycle, in particular, a valve device using an aluminum alloy material excellent in intergranular corrosion resistance.

2. Prior Art

A valve device such as a solenoid controlled valve and a thermostatic expansion valve has been used for a refrigerating cycle of, for example, a vehicle air conditioner. The valve device conventionally has a main body mainly made of an aluminum alloy material.

As the aluminum alloy material used for the valve main body, a JIS 6262 alloy extruded material has been used due to its secured machinability. However, this material needs to undergo an alumite treatment in order to increase its corrosion resistance for using such a purpose, which has caused a problem of a high production cost.

In order to eliminate the alumite treatment, a JIS 6063 alloy excellent in corrosion resistance and machinability can be used for the valve device instead of the 6262 alloy poor in corrosion resistance. However, in case that the valve device, for example a thermostatic expansion valve, using the 6063 alloy is provided in an engine room having a sever corrosive environment with the valve combined with a member of dissimilar metal such as stainless and brass, there is a possibility that an electrolytic corrosion due to a potential difference between the 6063 alloy and the dissimilar metal causes an intergranular corrosion in the 6063 alloy, which is rarely caused in the 6063 alloy in a usual case. That is, corrosion occurs on grain boundaries in preference to the other parts of the alloy. When such an intergranular corrosion occurs on an inner surface layer of refrigerant passages and the like formed in the thermostatic expansion valve, the crystal grains in the corroded surface layer are likely to be loosened and finally separated from the surface layer. With increase in the corrosion loss, the original surface layer breaks away to give a leakage pass through which the refrigerant leaks from the refrigerant passages. Therefore, it has been desired to prevent the problem of refrigerant leakage by suppressing the intergranular corrosion of the aluminum alloy material.

SUMMARY OF THE INVENTION

The present invention has been made in light of the above-mentioned problem and it is accordingly an object of the present invention to provide a valve device having substantially no or an extremely decreased refrigerant leakage by using an aluminum alloy material excellent in intergranular corrosion resistance without an alumite treatment.

According to the present invention, provided can be a valve device including a main body formed with a passage for allowing a refrigerant to flow therethrough; and a valve member provided in the passage. The main body includes an aluminum alloy containing 0.2 to 1.5 weight % of Si; 0.2 to 1.5 weight % of Mg; 0.001 to 0.2 weight % Ti; at least 0.1 weight % of Mn, Zr or the both; and Al and inevitable impurities. The aluminum alloy material has a fiber structure.

It is preferred that the maximum contents of Mn and Zr contained in the aluminum alloy material are respectively 1.0 weight % and 0.5 weight %.

The valve device may be a thermostatic expansion valve or a solenoid controlled valve. In case of the thermostatic expansion valve, the main body is formed with a first passage for a liquid-phase refrigerant; a second passage for a vapor-phase refrigerant obtained by vaporizing of the liquid-phase refrigerant; and an orifice provided in the first passage and adapted for adiabatically expanding the liquid-phase refrigerant, and the valve member is provided near the orifice.

It is preferred that each crystal grain of the aluminum alloy material has an aspect ratio (a grain length/a grain thickness) of 10 or more.

The refrigerant passage may have an inner surface substantially parallel to a fiber direction of the fiber structure. A fiber direction means an elongated direction (i.e., a direction of the grain length) of the crystal grains constituting the fiber structure.

The aluminum alloy material is preferably an extruded material. In this case, an aluminum alloy ingot may be homogenized at 450 to 550° C. before the extrusion. In the extrusion of the ingot, preferable extrusion temperature and extrusion rate are respectively 470 to 550° C. and less than 40 m/min.

DETAILED DESCRIPTION OF THE INVENTION

Figure 1:
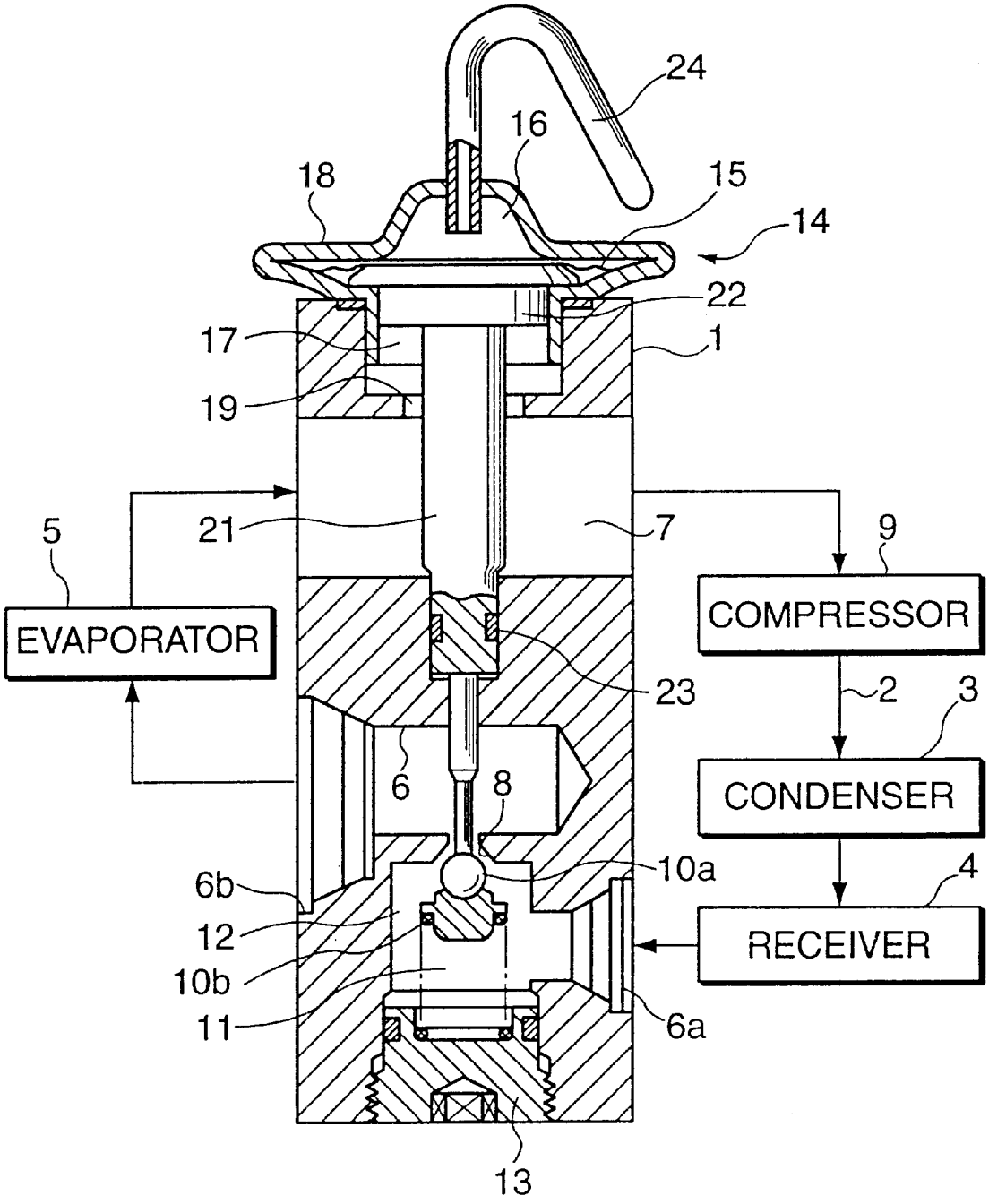
FIG. 1 is a sectional view showing a thermostatic expansion valve together with a refrigerating cycle system.
Figure 2:
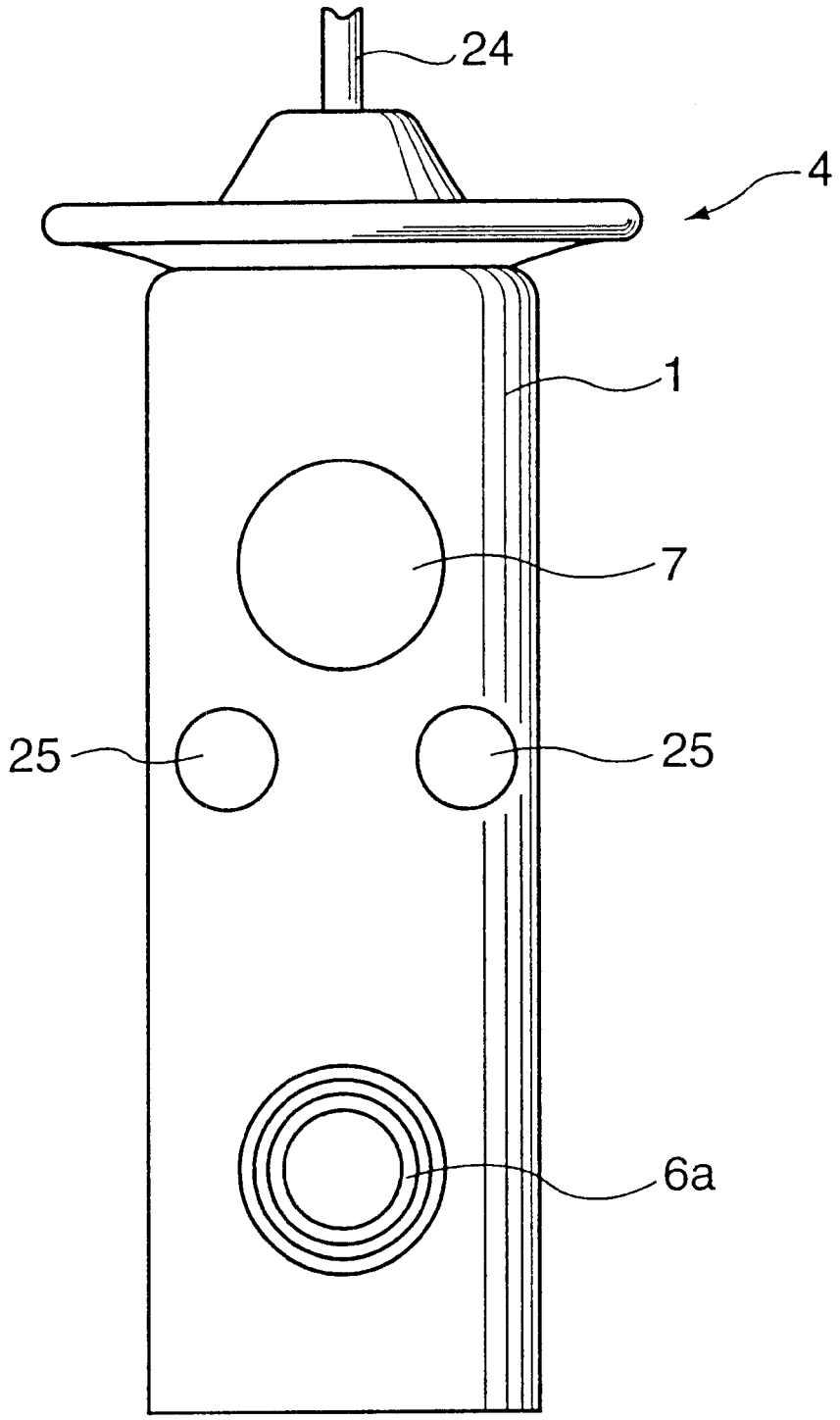
FIG. 2 is a side view of a thermostatic expansion valve without showing an internal structure.

Referring to FIGS. 1 and 2, one embodiment of a valve device according to the present invention is described below.

FIG. 1 is a diagram showing a thermostatic expansion valve disclosed in Japanese Unexamined Patent Publication No. Hei10-267470. As shown in the figure, the valve is incorporated in a refrigerating cycle system of, for example, a vehicle air conditioner. The refrigerating cycle system has a refrigerant conduit 2 extending from a refrigerant outlet of a condenser 3 to a refrigerant inlet of an evaporator 5 through a receiver 4 and a first passage of the valve, and returning from a refrigerant outlet of the evaporator 5 to a refrigerator inlet of the condenser 3 through a second passage 7 of the valve and a compressor 9.

The thermostatic expansion valve has a main body 1 in the shape of a near rectangular parallelepiped. The main body 1 is formed with the first passage 6 and the second passage 7 spaced apart one above the other, each of which forms a part of the refrigerant conduit 2 of the refrigerant cycle system. The first passage 6 interposes between the refrigerant inlet of the evaporator 5 and a refrigerant outlet of the receiver 4, and the second passage 7 interposing between the refrigerant outlet of the evaporator 5 and a refrigerator inlet of the compressor 9. Formed in the first passage 6 is an orifice 8 for adiabatically expanding a liquid-phase refrigerant supplied from the refrigerant outlet of the receiver 4. The orifice 8 has its center line along the length of the main body 1. A valve seat is formed at the inlet of the orifice 8. Near the orifice 8, a valve element 10*a* is supported by a support member 10*b*. The valve element 10*a* is pressed upward by an energizing means 11 such as a compression coil spring through the support member 10*b*.

The first passage 6 has a refrigerant inlet 6*a* through which the liquid-phase refrigerant is introduced from the receiver 4 and a refrigerant outlet 6*b* through which the refrigerant is supplied to the evaporator 5. The main body 1 is provided with the refrigerant inlet 6*a* and a valve chamber 12 that are in communication with each other. The valve chamber 12, a chamber with a bottom, constitutes a part of the first passage, and is formed coaxially with the center line of the orifice 8 and closed by a plug 13. At the top end of the main body 1, a valve driver 14 including a temperature-sensing element for driving the valve element 10*a* is fixed with screws. The valve driver 14 has a pressure-activated housing 18 whose inner space is partitioned into two pressure-activated rooms (16 and 17) one on the other by a diaphragm 15. The lower pressure-activated room 17 in the pressure-activated housing 18 is in communication with the second passage 7 through an equalizer hole 19 formed coaxially with the center line of the orifice 8.

A refrigerant vapor (vapor-phase refrigerant) that has passed through the evaporator 5 flows through the second passage 7 and a pressure of the refrigerant vapor gives a load on the lower pressure-activated room 17 through the equalizer hole 19. A valve drive rod 21 extending from the lower surface of the diaphragm 15 through the passage 7 down to the orifice 8 in the first passage 6 is disposed through the equalizer hole 19 coaxially therewith. The valve drive rod 21 has a stopper 22 at the top thereof for coming into contact with the lower surface of the diaphragm. The valve drive rod is supported by inner surfaces of the lower pressure-activated room 17 of the pressure-activated housing 18 constituting the valve drive device 14 and a partition wall between the first passage 6 and the second passage 7 in the main body 1 so as to slide vertically along its length, and its lower end comes in contact with the valve element 10*a*. In addition, in order to prevent leakage of the refrigerant between the first and second passages 6 and 7, a sealing member 23 is mounted on a portion of the outer surface of the valve drive rod 21 interfitting into a rod sliding guide hole formed in the partition wall.

A known heat sensitive fluid for driving the diaphragm fills the upper pressure-activated room 16 of the pressure-activated housing 18 and heat of the refrigerant vapor discharged from the evaporator 5 and flowing through the second passage 7 is transferred to the heat sensitive fluid through the valve drive rod 21 serving as a temperature sensing rod, which is exposed to the second passage 7 and the equalizer hole 19 in communication with the second passage 7, and the diaphragm 15. A reference numeral 24 indicates a heat sensitive fluid charge tube that is closed after the charging.

The heat sensitive fluid for driving the diaphragm in the upper pressure-activated room 16 is gasified by the heat transferred thereto. The increased pressure due to the gasification gives a load on the upper surface of the diaphragm 15. The diaphragm 15 shifts upward or downward according to a difference between the given loads on the upper and lower surfaces thereof. Such a vertical shift of the diaphragm 15 is transferred to the valve element 10*a* through the valve drive rod 21 to move the valve element 10*a* toward or away from the valve seat of the orifice 8. This makes possible to control the flow rate of the refrigerant flowing through the orifice 8.

As shown in FIG. 2, main body 1 has two bolt holes 25 for connecting this expansion valve with its matching members.

The main body 1 of the thermostatic expansion valve having the above structure is manufactured by machining an aluminum alloy material. It is necessary to machine the first passage 6 having the orifice 8, a valve chamber 12 and the like in communication therewith. On the contrary, machining only a straight through hole is needed to form the second passage 7. This is because the second passage 7 only has a function to pass the vapor-phase refrigerant returning from the evaporator 5 to the compressor 26 therethrough. It is also easy to form each two bolt holes 25 only for passing a bolt therethrough.

The main body is mainly made of the aluminum alloy material containing the following compositions.

Si: 0.2 to 1.5 weight % and Mg: 0.2 to 1.5 weight %

Si and Mg have an effect of improving a strength and machinability (cutting ability) of the aluminum alloy, resulting from precipitation of $Mg_2Si$. However, when the aluminum alloy has less than 0.2 weight % of Si or Mg, the above-mentioned effect cannot be obtained sufficiently. On the other hand, when the aluminum alloy has more than 1.5 weight % of Si or Mg, productivity in extrusion of the alloy is greatly lowered. Accordingly, preferable contents of Si and Mg are respectively in the range of 0.2 to 1.5 weight %.

Ti: 0.001 to 0.2 weight %

Ti has an effect of refining crystal grains in the cast structure of aluminum alloy. However, when the aluminum alloy has less than 0.001 weight % of Ti, the grain refining effect cannot be obtained sufficiently. On the other hand, when the Ti content exceeds 0.2 weight %, the grain refining effect of Ti cannot further increase. In addition, such a large Ti content considerably decreases productivity in extrusion of the aluminum alloy. Accordingly, preferable content of Ti is in the range of 0.001 to 0.2 weight %.

Mn, Zr or both of Mn and Zr: 0.1 weight % or more

Mn and/or Zr are added with the aluminum alloy in order to give a fiber structure to the resultant material such as the extruded material. However, in case that either Mn or Zr is added in a content of less than 0.1 weight %, or that the both are added in a total content of less than 0.1 weight %, the fiber structure cannot be formed effectively in the resultant aluminum alloy material. On the other hand, when Mn content exceeds 1.0 weight % or Zr content exceeds 0.5 weight %, the aluminum ally has a decreased productivity in extrusion thereof. Moreover, the extruded aluminum alloy has a higher sensitivity against hardening, resulting in a low hardenability thereof. The low hardenability decreases strength (proof stress) and machinability of the aluminum alloy material. In summary, in case of adding either Mn or Zr, respective contents of Mn and Zr are preferably 0.1 weight % or more, and more preferable Mn and Zr contents are respectively 0.1 to 1.0 weight % and 0.1 to 0.5 weight %. In other case of adding both Mn and Zr, the sum of Mn and Zr contents is preferably 0.1 weight % or more, and more preferably 0.1 to 1.5 weight %. In this case, Mn and Zr contents are respectively 1.0% or less and 0.5% or less.

From the view points of the fiber structure formation, the sensitivity against hardening and the productivity in extrusion of the aluminum alloy, further preferable contents of Mn and Zr are respectively 0.1 to 0.8 weight % and 0.1 to 0.3 weight %, in case of adding either Mn or Zr; and further preferable sum of Mn and Zr contents is 0.1 to 0.8 weight % (in this case, contents of Mn and Zr are respectively 0.8% or less and 0.3% or less), in case of adding both Mn and Zr. Still further preferable contents of Mn and Zr are respectively 0.3 to 0.6% and 0.1 to 0.3%, in case of adding either Mn or Zr; and still further preferable sum of Mn and Zr contents is 0.3 to 0.6 weight % (in this case, contents of Mn and Zr are respectively 0.6% or less and 0.3% or less), in case of adding both Mn and Zr.

According to the present invention, the aluminum alloy material for the main body of the valve device has a structure in which each crystal grain thereof is elongated along a specified direction to have an aspect ratio of L (a grain length)/ST (a grain thickness) of 10 or more. Hereinafter, such an alloy structure is referred to as "a fiber structure" and the grain-elongated direction of the fiber structure is referred to as "a fiber direction". The aluminum alloy material having such a structure is produced from the aluminum alloy having the above-mentioned compositions by, for example, the following method.

Mn and Zr are added with an aluminum alloy including Mg, Si and Ti in the above composition ranges to prepare the Mn, Zr-added alloy. Then the alloy is molten and cast to obtain an ingot, followed by a hot extrusion and then a press quenching (i.e., quenching the extruded aluminum alloy immediately after the extrusion). Due to the extrusion and the like under predetermined conditions, obtained can be an aluminum alloy extruded material having the fiber structure whose crystal grains are elongated along the extruded direction.

The valve main body according to the present invention is produced by machining the aluminum alloy material having the fiber structure. In the machining, it is preferred to form the refrigerant passage whose inner surface is substantially parallel to the fiber direction. For example, the main body shown in FIG. 1 preferably has a horizontal fiber direction, that is, a horizontal extruded direction. This is because, when an intergranular corrosion occurs on the inner surface, the corrosion can be prevented from propagating to the deep along the grain thickness direction, which is perpendicular to the fiber direction. This makes possible to suppress looseness of the passage inner surface layer, resulting in an effect of minimizing the refrigerant leakage.

In order to realize the effect, the aluminum alloy material of the present invention needs to have the fiber structure, that is, a structure in which each crystal grain has an aspect ratio of L (a grain length)/ST (a grain thickness) of 10 or more. This is because, when the aspect ratio of the alloy structure is less than 10, it is easier that the intergranular corrosion propagates in the grain thickness direction, resulting in a poor intergranular corrosion resistance. It should be noted that the grain length of the aspect ratio, L, means a grain length along the fiber direction (i.e., the extruded direction, in case of the extruded material); and the grain thickness, ST, means a grain thickness perpendicular to the fiber direction.

The preferable conditions for producing the aluminum alloy material having such a fiber structure by an extrusion are described below.

It is preferred to homogenize the aluminum alloy ingot before the extrusion. The homogenization treatment is desirably performed at 450 to 550° C. for 4 to 24 hr. In case that the homogenization temperature is lower than 450° C., Mn and/or Zr cannot sufficiently precipitate and thereby makes the fiber structure formation difficult. On the other hand, in case that the homogenization temperature is higher than 550° C., each precipitate of Mn and/or Zr on the grain boundaries is likely to have a relatively large size, which also prevents the fiber structure formation. In both cases of the homogenization temperature being within the above-described undesirable temperature ranges, the resultant aluminum alloy extruded material is likely to have a recrystallized structure having an aspect ratio of less than 10.

In addition, preferable extrusion temperature of the aluminum alloy is 470 to 550° C. When the extrusion temperature is lower than 470° C., that is, lower than the homogenization temperature, the extruded aluminum alloy cannot be quenched in air or water, resulting in poor mechanical properties. On the other hand, when the extrusion temperature is higher than 550° C., each size of Mn and/or Zr precipitate is increased. Such large precipitates are likely to prevent forming a fiber structure therein, resulting in forming a recrystallized structure instead.

In the extrusion of the aluminum alloy ingot, preferable extrusion rate is 40 m/min or less. When extruded at a high rate of beyond 40 m/min, only the surface of the extruded alloy is likely to be heated. Thus, the surface temperature rises too high to elongate the crystal grains sufficiently, thereby giving a recrystallized structure to the surface portion of the extruded alloy. In addition, such a high extrusion rate results in a poor dimensional precision of the extruded alloy to reduce a dimensional accuracy of the obtained extruded product. On the other hand, when the extrusion rate is too low, although the fiber structure can be formed, a manufacturing cost is too high in terms of industrial production. Therefore, the extrusion rate is desirably 10 m/min or more.

The present invention is effectively applied to any other kinds of valve devices which having a refrigerant passage therein such as a solenoid valve. In addition, the aluminum alloy material used in the present invention is not limited to the extruded material produced in the above-described manner.

As described above, according to the present invention, solved can be the conventional problem of the refrigerant leakage in the valve device resulting from an intergranular corrosion of 6063 alloy containing none of Mn and Zr. That is, the 6063 alloy has a coarse equiaxed grain structure (a recrystallized structure) and, when used for the above thermostatic expansion valve, the intergranular corrosion is likely to occur on an alloy surface and propagate easily to the deep, resulting in loosening the crystal grains and separating them from the corroded surface layer. With increase in the corrosion loss, the surface layer may break away to give a leakage path for the refrigerant. On the contrary, the inventive aluminum alloy material has the above-described fiber structure by adding predetermined amounts of Mn and/or Zr therewith, and therefore its crystal grains are greatly refined and elongated so as to suppress the intergranular corrosion and cause a pitting corrosion instead. The pitting corrosion rarely loosens the crystal grains and separates them from the alloy surface layer. As a result, the corrosion loss due to the pitting corrosion is extremely small, compared with the case of the intergranular corrosion, to completely remain the original surface layer. Therefore, with use of the inventive alloy material, obtained can be a valve device such as a thermostatic expansion valve with substantially no or an extremely decreased refrigerant leakage.

EXAMPLE

Examples of an aluminum alloy material according to the present invention are described by comparison with comparative examples in the followings.

Al—Mg—Si based aluminum alloys having chemical compositions shown in Table 1 were molten by an ordinary method, and cast into billets of 200 mm in diameter by a semi-continuous casting. Each billet was homogenized at 500° C. for 6 hours and then hot extruded at 500° C. into a square rod of 20 mm×50 mm in section. The extrusion was performed at a rate of 20 m/min. The extruded rod was subjected to a water cooling press quenching immediately after the extrusion, followed by an aging treatment to obtain a sample rod. It should be noted that, in Example 11, 6063 alloy is used as the Al—Mg—Si based aluminum alloy.

Each obtained sample rod is then subjected to the following hardness measurement and corrosion type determination test. The results are shown in Table 1.

Hardness measurement: A cross section perpendicular to an extrusion axis of each sample rod was ground with an emery paper (#2400) and a cross section hardness was measured with a micro-Vickers hardness meter according to JIS 2244 standard (given load on the cross section: 19.6 N).

Figure 3:
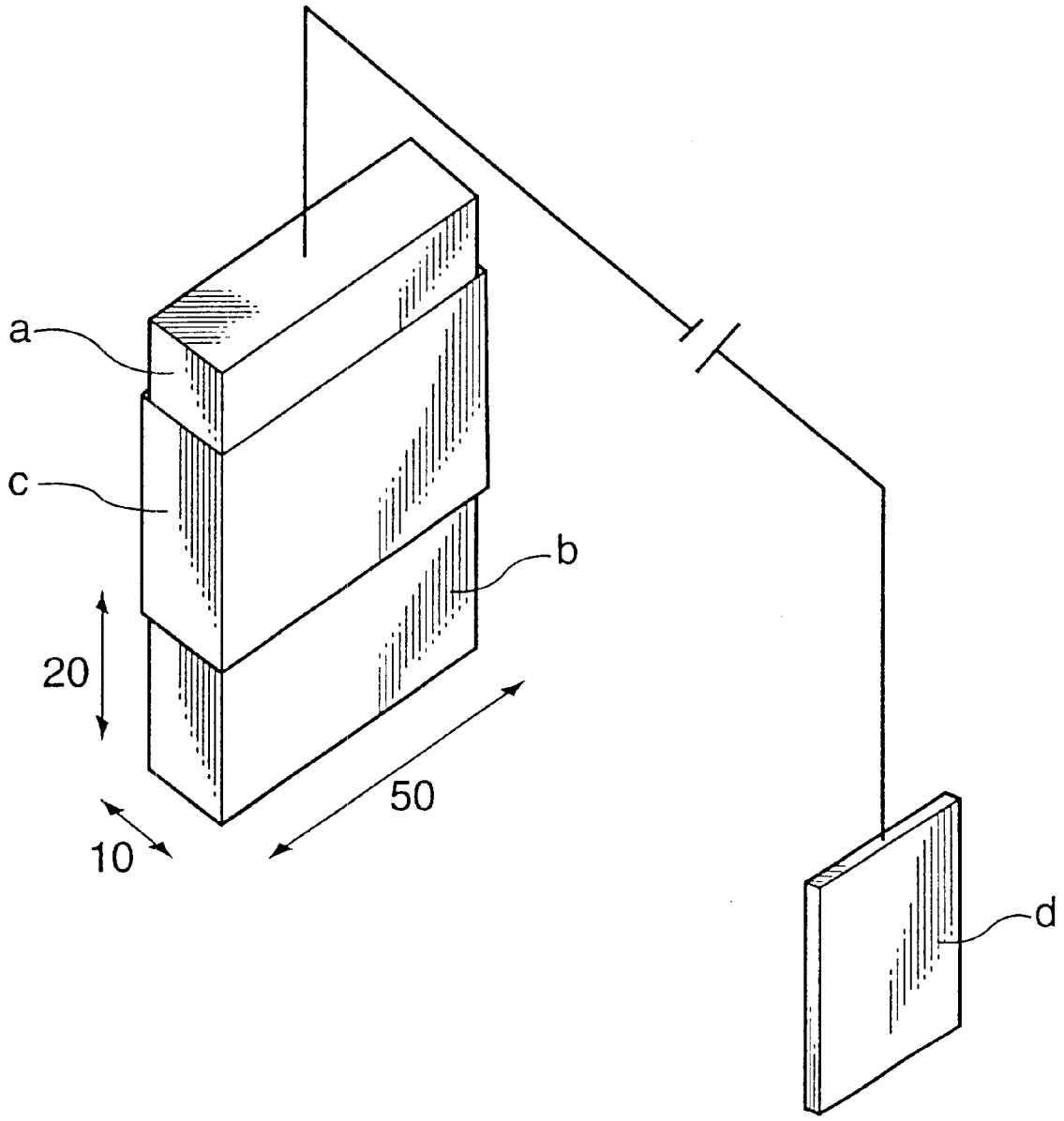
FIG. 3 is a schematic diagram for illustrating a corrosion type determination test.

Corrosion type determination test: Both surfaces of each sample rod were milled until the sample rod has a thickness of 10 mm, and degreased with acetone to prepare a corrosion test piece. The test piece was then subjected to a corrosion type determination test as follows: The test piece was sealed with tape except a connecting portion a and a test portion b (20 mm×50 mm×10 mm) as shown in FIG. 3; and then, the lower half of the sealed portion c of the sample rod was immersed in a testing liquid, to perform a corrosion test by applying a current between an electrode d and the sample rod. As the testing liquid, 5%-NaCl liquid was used. The test was performed under the conditions of a liquid amount per-unit area of 150 cc/cm$^2$, a test temperature of room temperature and a current density of 4 mA/cm$^2$, and it was continued for 24 hr. After the corrosion test, the test portion b was cut along a direction perpendicular to the extrusion direction to observe the cross section structure using a stereomicroscope for determining its corrosion type.

TABLE 1

| | | Composition (mass %) | | | | | Hardness | corrosion type determination test | |
|---|---|---|---|---|---|---|---|---|---|
| | No | Si | Mg | Mn | Zr | Ti | (Hv) | corrosion type | |
| inventive example | 1 | 0.55 | 0.70 | 0.10 | — | 0.03 | 102 | pitting corrosion | ○ |
| | 2 | " | " | 0.20 | — | " | 99 | pitting corrosion | ○ |
| | 3 | " | " | 0.40 | — | " | 96 | pitting corrosion | ○ |
| | 4 | " | " | 0.60 | — | " | 86 | pitting corrosion | ○ |
| | 5 | " | " | — | 0.10 | " | 102 | pitting corrosion | ○ |
| | 6 | " | " | — | 0.20 | " | 99 | pitting corrosion | ○ |
| | 7 | " | " | 0.10 | 0.10 | " | 99 | pitting corrosion | ○ |
| | 8 | " | " | 0.40 | 0.10 | " | 94 | pitting corrosion | ○ |
| comparative example | 9 | " | " | 0.05 | — | " | 101 | intergranular corrosion | × |
| | 10 | " | " | — | 0.05 | " | 102 | intergranular corrosion | × |
| | 11 | " | " | — | — | " | 103 | intergranular corrosion | × |

As shown in Table 1, pitting corrosion occurs on test pieces of Examples 1 to 8 containing the predetermined contents of Mn and/or Zr, whereas intergranular corrosion occurs on those of Examples 9 to 11 containing Mn or Zr less than the predetermined contents. In addition, each test piece of Examples 1 to 8 had a fiber structure, whereas that of Examples 9 to 11 had a recrystallized structure.

Figure 4:
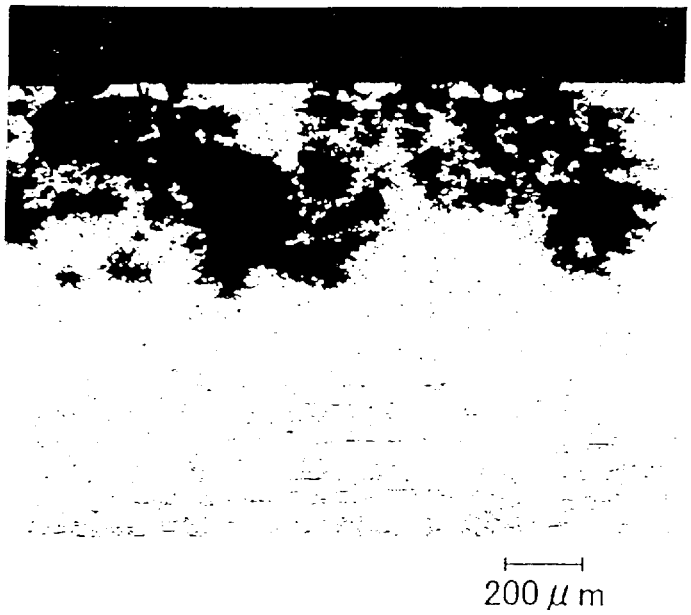
FIG. 4 is an optical microphotograph of a microstructure of the test piece having intergranular corrosion in Example 11.

FIG. 4 shows a microphotograph of the test piece of example 11 having an intergranular corrosion. As seen from FIG. 4, grain boundaries corrode from its surface to the deep in preference to the other parts, to give a corroded surface layer. In this layer, crystal grains surrounded with the corroded boundaries are loosened and separated from the test piece surface, thereby increasing the corrosion loss. As a result, the corroded surface cannot remain as it were due to the loss of almost all of the original grains constituting the layer.

Figure 5:
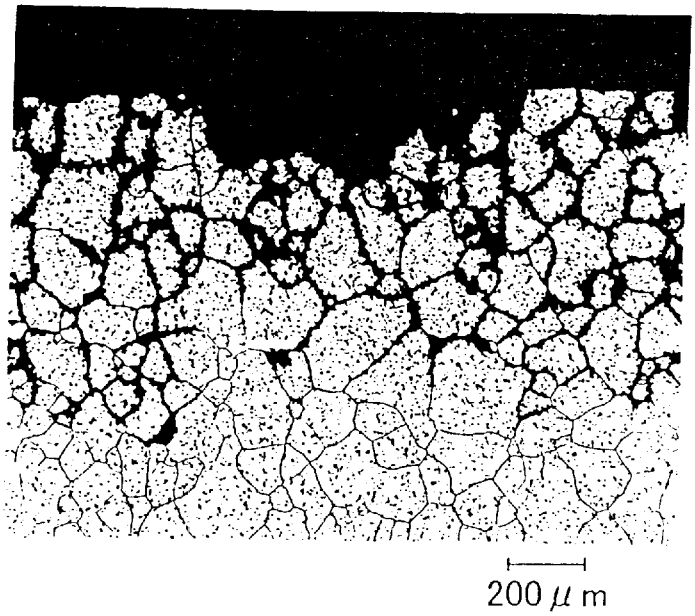
FIG. 5 is an optical microphotograph of a microstructure of the test piece having pitting corrosion in Example 3.

On the contrary, FIG. 5 shows a microphotograph of the test piece of Example 5 having a pitting corrosion. As seen from FIG. 5, fewer crystal grains separate from the test piece surface even within a pitting corrosion region, thereby lessening the corrosion loss. As a result, the original test piece surface can remain as it were by the original crystal grains remaining on the test piece surface.

Furthermore, as seen from Table 1, each sample rod of Examples 1 to 8 has a hardness substantially same level as that of Example 11 (i.e., 6063 alloy). It also exhibits excellent strength and machinability comparable to those of the 6063 alloy.

In examples 12 to 19, further sample rods and their test pieces were respectively produced with using the same alloy compositions as those in former Examples as shown in Table 2. The conditions of homogenization and extrusion for respective sample rods are also shown in Table 2.

Each sample rod was then cut in a plane including the extrusion direction to be observed its microstructure with using a stereoscopic microscope, followed by an aspect ratio measurement of the microstructure. Subsequently, a test piece was prepared from the sample rod and subjected to the corrosion type determination test in the same manner as in the former examples. Results are also shown in Table 2.

TABLE 2

| No | Composition | Homogenization ° C. × hr | extrusion temp. ° C. | extrusion rate m/min. | results structure | aspect ratio | corrosion type |
|---|---|---|---|---|---|---|---|
| 12 | Same as No. 3 | 480 × 6 | 530 | 20 | fiber structure | ≧10 | ○ pitting corrosion |
| 13 | Same as No. 3 | 500 × 6 | 480 | 30 | fiber structure | ≧10 | ○ |
| 14 | Same as No. 5 | 480 × 6 | 500 | 20 | fiber structure | ≧10 | ○ |
| 15 | Same as No. 8 | 500 × 6 | 500 | 20 | fiber structure | ≧10 | ○ |
| 16 | Same as No. 3 | 580 × 6 | 530 | 20 | recrystallized structure | 3 | × intergranular corrosion |
| 17 | Same as No. 3 | 500 × 6 | 580 | 20 | recrystallized structure | 7 | × |
| 18 | Same as No. 9 | 500 × 6 | 480 | 30 | recrystallized structure | 5 | × |
| 19 | Same as No. 11 | 500 × 6 | 480 | 30 | recrystallized structure | 2 | × |

The extruded materials of the above-described inventive examples (Nos. 1–8 and 12–15) can effectively applied to a valve device for a refrigerating cycle system such as a solenoid controlled valve and a thermostatic expansion valve, particularly to a main body of the valve device having a refrigerant passage formed therein. Such a main body has an excellent intergranular corrosion resistance in addition to a satisfactorily high strength, resulting in preventing the above-mentioned refrigerant leakage.

As described above, according to the present invention, the specified aluminum alloy material that replaces 6063 alloy due to its excellent intergranular corrosion resistance is used for a valve device incorporated in a refrigerating cycle system. This can prevent leakage of a refrigerant passing thorough a refrigerant passage formed in the valve device.

This application is based on patent application No. 2000-303278 filed in Japan, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A valve device comprising:

a main body formed with a passage for allowing a refrigerant to flow therethrough; and a valve member provided in the passage, wherein the main body includes an aluminum alloy containing:
0.2 to 1.5 weight % of Si;
0.2 to 1.5 weight % of Mg;
0.001 to 0.2 weight % Ti;
at least 0.1 weight % of Mn, Zr or the both; and
Al and inevitable impurities, the aluminum alloy material having a fiber structure.

2. The valve device in accordance with claim 1, wherein the maximum content of Mn contained in the aluminum alloy material is 1.0 weight %.

3. The valve device in accordance with claim 1, wherein the maximum content of Zr contained in the aluminum alloy material is 0.5 weight %.

4. The valve device in accordance with claim 1, wherein the valve device is a thermostatic expansion valve, the main body is formed with:

a first passage for a liquid-phase refrigerant;

a second passage for a vapor-phase refrigerant obtained by vaporizing of the liquid-phase refrigerant; and an orifice provided in the first passage and adapted for adiabatically expanding the liquid-phase refrigerant, and the valve member is provided near the orifice.

5. The valve device in accordance with claim 1, wherein the valve device is a solenoid controlled valve.

6. The valve device in accordance with claim 1, wherein the aluminum alloy material is an extruded material.

7. The valve device in accordance with claim 1, wherein each crystal grain of the aluminum alloy material has an aspect ratio of 10 or more.

8. The valve device in accordance with claim 1, wherein the refrigerant passage has an inner surface substantially parallel to a fiber direction of the fiber structure.

9. The valve device in accordance with claim 6, wherein the extruded material is produced by homogenizing an aluminum alloy ingot and extruding the homogenized ingot.

10. The valve device in accordance with claim 9, wherein the homogenization is performed at a temperature of 450 to 550° C.

11. The valve device in accordance with claim 9, wherein the extrusion is performed at a temperature of 470 to 550° C.

12. The valve device in accordance with claim 9, wherein the extrusion is performed at an extrusion rate of less than 40 m/min.

* * * * *